United States Patent [19]

Gulick

[11] 4,315,709

[45] Feb. 16, 1982

[54] APPARATUS FOR TRANSPORTING THE MALE ENDS OF THREADED TUBING, PIPE, OR THE LIKE

[75] Inventor: Jonathan F. Gulick, Philadelphia, Pa.

[73] Assignee: Cities Service Company, Tulsa, Okla.

[21] Appl. No.: 130,649

[22] Filed: Mar. 17, 1980

[51] Int. Cl.[3] ..... E21B 19/14

[52] U.S. Cl. ..... 414/22; 414/786

[58] Field of Search ..... 414/22, 745, 786; 175/85

[56] References Cited

U.S. PATENT DOCUMENTS

| | | | |
|---|---|---|---|
| Re. 24,907 | 12/1960 | Maydew | 414/22 |
| 967,040 | 8/1910 | McWane et al. | 414/22 X |
| 2,296,705 | 9/1942 | Childress | 414/22 X |
| 2,535,546 | 12/1950 | Pitts | 414/22 |
| 2,615,585 | 10/1952 | Menhall | 414/22 |
| 3,083,842 | 4/1963 | Bauer et al. | 414/22 |
| 3,143,221 | 8/1964 | Blackmon | 414/22 |
| 3,655,071 | 4/1972 | Langowski et al. | 414/22 |

*Primary Examiner*—Leslie J. Paperner

*Attorney, Agent, or Firm*—Richard D. Stone; John W. Carpenter

[57] ABSTRACT

A process for protecting the threaded male end of tubing or the like in a drilling operation when, e.g., tubing is pulled from the ground comprising placing the male end of tubing in a transport means including a base on at least one rolling means and transporting said male end of tubing in the transport means while the female end of the tubing is engaged or suspended in the drilling operation.

5 Claims, 4 Drawing Figures

FIG. 1
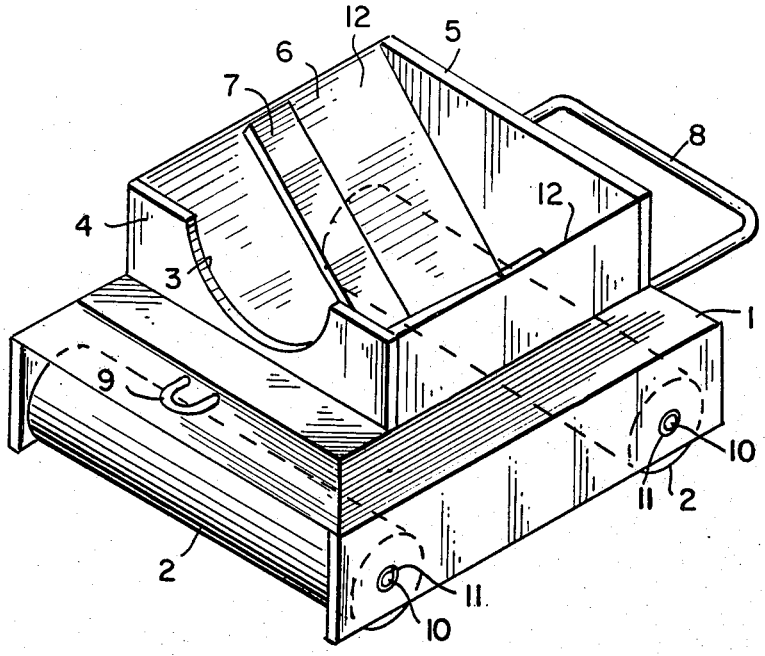
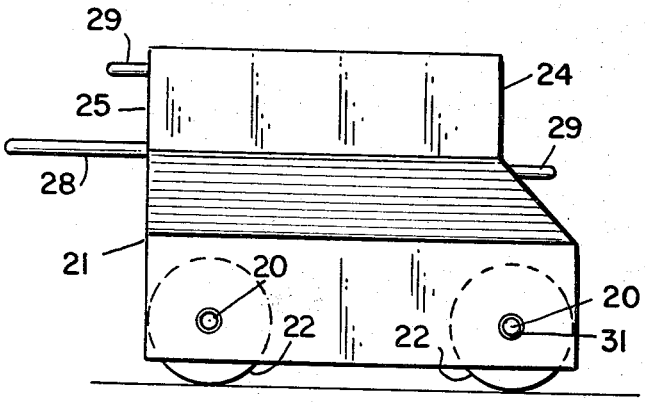
FIG. 2
FIG. 3
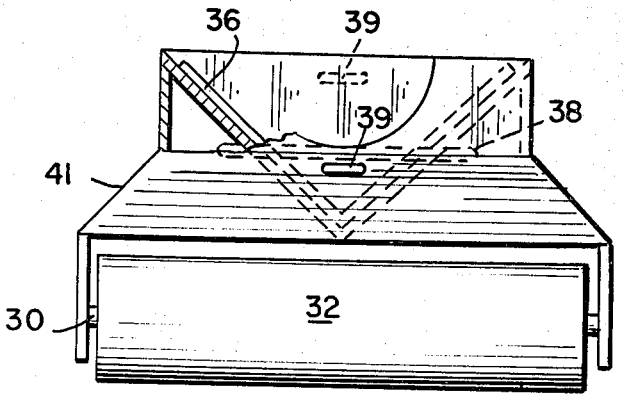

APPARATUS FOR TRANSPORTING THE MALE ENDS OF THREADED TUBING, PIPE, OR THE LIKE

BACKGROUND OF THE INVENTION

In drilling for oil, water, or other substances beneath the earth, much use is made of strings of pipe. The pipe, tubing, or the like, may be used to add fluids to, or remove them from the earth. Pipes are also used as a means of transmitting power to a drilling device, e.g., rotary drill. Pipes are also used in certain well repair operations, i.e., well workovers. Usually, a string of pipe is used comprising many individual threaded sections to make up the desired length of pipe or tubing. As pipe goes down the hole, extra sections are threaded on.

In a drilling and/or workover operation, the pipe is usually placed near the well bore to minimize transport and handling of the tubing. The tubing or pipe may be stored vertically, if there is room for storage on the drilling rig. Frequently, such storage is not available, either because of the great amount of pipe involved, or because a relatively small "workover" rig is used to pull tubing, and such small rigs cannot accomodate any significant amount of pipe in vertical storage. In these cases, the pipe is stored horizontally, near the well site.

Typically, a joint of tubing is removed from the well string by unscrewing it from the well string. Usually the threaded or male end, of the pipe is pointing downward, with the top end of the joint of tubing being supported from the top of the derrick. The threads are conventionally protected by metal or plastic caps, with the capped end then being slid along a rack of pipes. Unfortunately, the threaded ends, even when capped, are subject to much wear and consequent deterioration as a result of being slid along a rack of pipes. It would be very beneficial to the industry if a better way of moving the threaded pipe around were available. I studied the problem and found a way to eliminate most of the problems associated with prior art ways of "pulling tubing."

BRIEF SUMMARY OF THE INVENTION

Accordingly, the present invention provides a process for protecting the threaded male end of tubing, pipe, casing, or the like, in drilling and/or workover operations while displacing said tubing, pipe, casing, or the like, from a generally vertical posture in a drill hole to a horizontal placement for storage of same, or from a horizontal placement to a generally vertical posture in order to threadably engage the threaded female end of another tubing, pipe, casing, or the like, prior to entry into the drill hole, said process comprising engaging or suspending the female end of said tubing, pipe, casing, or the like, in order to aid in controlling and directing the same while it is being displaced; situating the threaded male end of said tubing, pipe, casing, or the like, in a male-end transport means including a base, at least one rolling means including a base, at least one rolling means rotatably secured to said base; and transporting said tubing, pipe, casing, or the like, to said desired placement while said female end is engaged or suspended and while said male end is situated in said male-end transport means.

My transport means rides on the top of several lengths of pipe. The transport means may be relatively close to the ground at the start of lay down operations, when riding on a single layer or pipe. After a considerable amount of pipe has been moved to a horizontal posture there will be many layers of pipe or tubing, and the transport means will be higher above the ground.

My device can be used as soon as there is enough tubing available to permit the device to roll upon the tubing. When tubing is being moved to the horizontal posture only two or three lengths of tubing are needed to permit easy horizontal movement of the device. If the surface conditions are adequate, i.e., a storage floor of relatively smooth hard-packed dirt, it may be possible to use the device even from the onset, when no tubing is horizontally stored on the ground. Alternatively, a length of board can be used for the initial horizontal traverses of the device.

My process for protecting the threaded ends of piping is especially important whenever moving internally coated or lined tubing or pipe. This material may be coated or lined to withstand the harsh environments encountered underground, i.e., the presence of salts, acids, hydrogen sulfide, erosive materials, and the like. Any damage to the internal lining may result in significant corrosion or even failure of the tubing, which would make it impossible to retrieve the lower end of the string without an expensive and time-consuming "fishing" job or workover.

BRIEF DESCRIPTION OF DRAWINGS

FIG. 1 is an isometric sketch of the present invention showing a transport means useful in practicing the process of the present invention.

FIG. 2 is a side view of the transport means in FIG. 1.

FIG. 3 is a front view of the transport means shown in FIG. 1.

DETAILED DESCRIPTION

Figure 4:
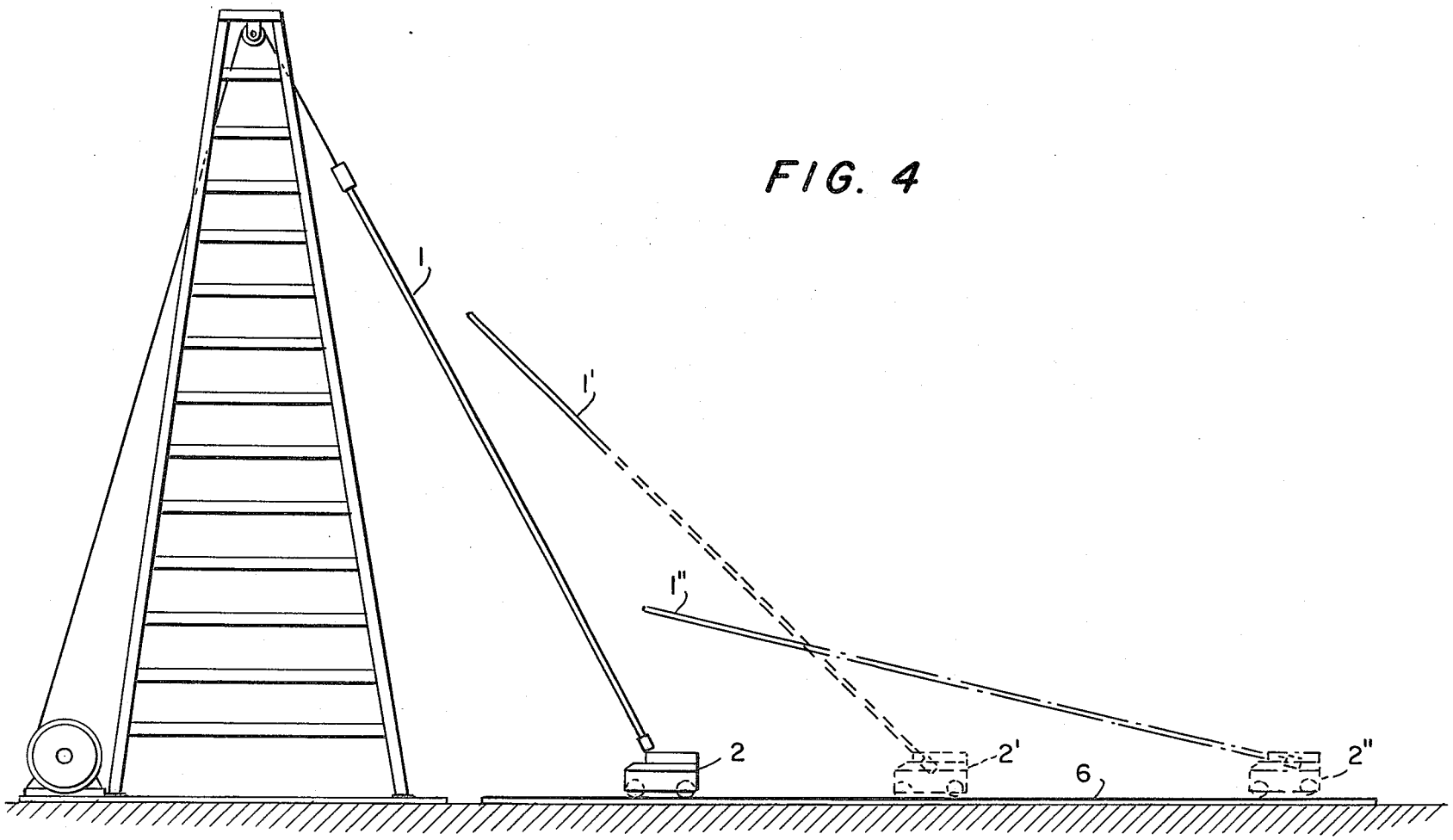
FIG. 4 is a simplified sketch, not to scale, showing the movement of tubing in the transport means at the beginning, middle, and end of a tube transport cycle.

FIG. 1 shows an isometric view of the apparatus used in the process of the present invention. Base 1 contains a pair of hard plastic rollers 2 mounted upon axles 10 rotatably mounted within openings 11 on base 1.

Base 1 contains trough 6 defined by two downwardly inclined side surfaces on side walls 12 connected to define a V-shape by end portions 4 and 5. Semi-cirular or curved opening 3, within front wall 4, helps align a joint of tubing within the trough. Back wall 5 is preferably without any recession. The function of wall 5 is to prevent the joint of tubing from slipping out of that end of the V trough. Retention means 7 is a metal strip secured to the bottom of trough 6 in a position intermediate end walls 5 and 4. Retention means 7 will minimize or prevent movement of tubing from end wall 5 to end wall 4, by engaging the cap which may be screwed on the male end of the threaded tubing.

Handle 8 is provided to simplify carrying the tubing pin roller around the job site. Rope loop 9, and handle 8, can be used as anchoring points for ropes or cables to help move the tubing pin roller back and forth.

FIG. 2 is a side view of the device shown in FIG. 1 with a slightly different base configuration. Rollers 22 are mounted on axles 20 fitted within aperatures 31 which are an integral part of base 21. Rope loops 29 are provided at both ends of the tubing pin roller, while handle 28 is only provided at one end. The ends of trough 6 of FIG. 1 are shown in FIG. 2 as end members 24 and 25.

FIG. 3 is a front view of the tubing pin roller shown in FIG. 1. Roller 32 is mounted upon axle 30 which is mounted within base 41. The V-shape of trough 36 is clearly shown in this drawing. Rope loop 39 and handle 38 are shown mounted to base 41.

FIG. 4 shows how the transport means or tubing pin roller is used in practice. Tubing joint 1 is lowered into tubing pin roller 2 which is resting upon layers of horizontally stored tubing 6. The tubing pin roller rolls back to an intermediate horizontal position upon tubing 6, as shown by the location of tubing pin roller 2′ containing a joint of tubing 1′. At the end of the horizontal traverse of the layers of pipe 6 the tubing pin roller is shown at the end of the pipe rack as tubing pin roller 2″ containing at an almost horizontal position, a joint 1″ of tubing.

Initial placement of tubing 1 within tubing pin roller 2 would usually be made manually with a gentle shove or kick given to tubing pin roller 2′ to promote horizontal movement of the tubing pin roller as the joint of tubing 1 is slowly lowered to the ground. When the joint of tubing has been lowered to the approximate level of the other tubing 6 already in horizontal storage, the tubing joint would be manually or mechanically lifted from tubing pin roller 2″ and set on top of other tubing. A worker could then kick tubing pin roller 2″ back for another joint of tubing, or alternatively, a rope may be attached, by means not shown in FIG. 4, and the tubing pin roller pulled back to receive another joint of tubing.

Materials which can be used to make the tubing pin roller are all readily available. I prefer the use of hard plastic rollers on steel rods. Hard plastic rollers two and one-half inches in diameter by 10 inches long work very well over axles of 9/16th inch steel rods. At least two rollers should be used to permit ease of horizontal movement. It would be possible to use even more rollers, e.g., 3, 4 or 5 or even more rollers in parallel, and such construction may be desirable if great load bearing capacity is required or if a low profile for the device is needed.

Alternate means of affixing the rollers to the base may also be used. One acceptable mode of construction would be the use of 5 or 10 roller skate wheels aligned on two parallel axles. The rollers should extend substantially across the entire length of the axle so that the transport means, or tubing pin roller, does not require precise alignment on top of the horizontally stacked pipe to permit free movement.

It is not essential to have end plates or front and back walls 4 and 5 as shown in FIG. 1. The V trough shape 6 will align the pipe to a great extent. In practice, if the axles are kept well lubricated, the rolling coefficient of friction between the tubing pin roller and horizontal tubes is always much less than the static friction between the threaded or capped end of pipe. The tubing, once placed on the tubing pin roller, will remain on the tubing pin roller as it traverses horizontally a rack of pipes, because the force required to move the threaded end of the pipe within the roller is greater than the force required to roll the tubing pin roller.

In practice, the rope loops, such as 9 and 10, are not often needed. If the device is made out of sturdy steel plate, e.g., one-quarter inch thick, the device has sufficient mass to roll horizontally from one end of the pipe rack to the other end with a simple shove. Use of a rope may not be necessary under some conditions. Whenever the outside surface of the pipe, or perhaps the roller surface, deteriorates significantly then the coefficient of rolling friction may increase enough to justify the use of a rope at either or both ends of the tubing pin roller to facilitate horizontal movement of the device.

Instead of trough 6, it may be desirable to provide a horizontal, preferably resilient, surface to engage the threaded end of the pipe. A foam, or solid rubber mat, in a perfectly flat, or V shaped configuration could be used to accomodate the threaded end of a pipe. When a resilient material is used to accomodate the threaded end, it may be possible to dispense with capping of the threaded end of the pipe, though I still prefer to cap the threaded ends of the pipe with a light weight plastic cap to give further insurance against damage to the threaded ends, or any material applied as a liner to the pipe or tubing.

When using a 10 inch roller, an axle length of 10.5 inches works well, the axle can simply be welded to the base, providing a very simple and rugged construction. It is also possible to build the axle into the base before the base is completely fabricated, or provide for the use of timken bearings or the like as a means of affixing the axle to the base. When using two and one-half inch rollers on a 10.5 inch axle, the height of the device, measured from the bottom of the base to the top of end portions 4 or 5 is ideally about 6.75 inches. The length of the end pieces 4 and 5, as measured in a direction parallel to the roller axles, is about 7 inches. The recession 3 provided in end plate 4 is preferably a semi-circle, with a diameter of about 4 inches, though a V shape may be used with good results. The horizontal plates 6 should be inclined to provide a V shape, which will help align the pipe within the tubing pin roller. A V-shape with an included angle of 90°, i.e., a right angle, gives very good results.

The length of the feed trough, as measured on an axis perpendicular to the length of the trough, or distance between end plates 4 and 5 should be about 7 inches. To minimize the amount of horizontal movement of tubing which must occur by hand at the beginning or end of a traverse, it is preferable that one end of the V trough be vertically aligned with one end of the base, as shown in the drawings. This permits the threaded end in the tubing pin roller to approach very closely the other threaded ends in a stack of tubing. There is a very slight loss of stability due to the somewhat lop-sided placement of the V trough, as compared to centering the trough between the axles, but in practice this is not a problem. Actually, this placement of the V trough minimizes problems of the device tilting forward when tubing is placed near the front. With the V trough moved back from the front, the tubing will prevent the tubing pin roller from flipping backwards, while the weight of the tubing pin roller's V trough, and asymmetrical location thereof, minimize the tendency of the device to tip forwards.

I claim:

1. A process for protecting the threaded male end of tubing, pipe, casing, or the like in drilling for subterranean substances, while displacing said tubing, pipe, casing, or the like, from a generally vertical posture in a drill hole to a horizontal placement for storage of same, or from a horizontal placement to a generally vertical posture in order to threadably engage the threaded female end of another tubing, pipe, casing, or the like, prior to entry into the drill hole, said process comprising:

(a) engaging or suspending the female end of said tubing, pipe, casing, or the like, in order to aid in controlling and directing the same while it is being displaced:

(b) situating the threaded male end of said tubing, pipe, casing, or the like, in a male end transport means comprising a trough means superimposed on a base for receiving said male end wherein said trough means includes a pair of slanting side walls, a back wall and a front wall attached to said slanting walls, said front wall having a structure defining a semicircular aperture wherein said tubing pipe, casing, or the like, rests while being transported and movement of said male end in said trough means is prevented while being trans ported and said base has at least two rolling means rotatably secured to said base and said trough is closer to one of said rolling means than the other of said rolling means; and (c) transporting said tubing, pipe, casing, or the like, by rolling said transport means along the storage floor or along a layer of previously stored tubing, pipe, casing, or the like to said desired placement while said female end is engaged or suspended and while said male end is situated in said male-end transport means.

2. The process of claim 1 additionally including removing said male end from said trough means after said tubing, pipe, casing, or the like, has reached a generally vertical posture or an essentially horizontal placement, depending on whether or not said tubing, pipe, casing, or the like, is being stored or is being interconnected for entry into the well or storage in a vertical posture.

3. The process of claim 2 additionally including returning said transport means to the other side of said layer of tubing, pipe, casing, or the like, or the storage floor, in order to protect another male end of tubing, pipe, casing, or the like, in the transporting of same.

4. An apparatus for protecting the threaded male end of tubing, pipe, casing, or the like, in drilling for subterranean substances, while displacing said tubing, pipe, casing, or the like, to or from a generally vertical posture in a drill hole to or from a horizontal placement for storage of same, said apparatus comprising a trough means superimposed on a base supported by rolling means, and wherein (a) said trough means includes a pair of slanting side walls, a back wall and a front wall attached to said slanting side walls, said front wall having a structure defining a semi circular aperture which accepts said tubing, pipe, casing, or the like, and means are included in said trough which engage with said male end and prevent movement during transport thereof, and (b) said base means is supported by at least two rolling means, rotatably secured to said base and said trough is closer to one of said rolling means than the other said rolling means, and said rolling means are adapted to permit rolling of said apparatus along a storage floor or along a layer of previously stored tubing, pipe, casing, or the like.

5. The apparatus of claim 4 wherein said trough means comprises at least one retention means attached to at least one of said side walls to lodge said male end between said back wall and said front wall in said retention means, preventing movement of said male end from the back wall to the front wall of said trough means.

* * * * *